US010865600B2

(12) United States Patent
Zhang et al.

(10) Patent No.: US 10,865,600 B2
(45) Date of Patent: Dec. 15, 2020

(54) WINDOW BLIND

(71) Applicant: Nien Made Enterprise Co., Ltd., Taichung (TW)

(72) Inventors: De-Jun Zhang, Dongguan (CN); Lin Chen, Taichung (TW); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 242 days.

(21) Appl. No.: 16/105,976

(22) Filed: Aug. 21, 2018

(65) Prior Publication Data

US 2019/0071925 A1 Mar. 7, 2019

(30) Foreign Application Priority Data

Sep. 5, 2017 (CN) ..... 2017 1 0790554

(51) Int. Cl.
*E06B 9/307* (2006.01)
*E06B 9/322* (2006.01)
*E06B 9/382* (2006.01)

(52) U.S. Cl.
CPC ..... *E06B 9/307* (2013.01); *E06B 9/322* (2013.01); *E06B 9/382* (2013.01); *E06B 2009/3222* (2013.01)

(58) Field of Classification Search
CPC ..... E06B 9/307; E06B 9/322; E06B 9/382; E06B 9/266; E06B 9/323; E06B 2009/3222; E06B 9/303
See application file for complete search history.

(56) References Cited

U.S. PATENT DOCUMENTS 7,832,453 B2 * 11/2010 Lin ..... E06B 9/307 160/168.1 R
8,939,190 B2 * 1/2015 Mullet ..... E06B 9/307 160/176.1 P
2012/0234506 A1 * 9/2012 Defenbaugh ..... E06B 9/386 160/168.1 R
2014/0014279 A1 * 1/2014 Defenbaugh ..... E06B 9/68 160/168.1 P
2014/0360682 A1 * 12/2014 Lee ..... E06B 9/303 160/174 R (Continued)

FOREIGN PATENT DOCUMENTS

CN 205370398 U 7/2016
EP 1 156 182 A2 11/2001

(Continued)

*Primary Examiner* — Beth A Stephan
(74) *Attorney, Agent, or Firm* — Winston Hsu

(57) ABSTRACT

A window blind includes a first rail, a second rail, a plurality of slats, a modulation mechanism, and an adjustment unit. The modulation mechanism includes a modulation shaft which can drive two warps of the ladder tape to make a relative movement in a vertical direction, whereby to modulate the slats to turn. When the slats are turned from a first position to a second position, the adjustment unit moves a rear cord which is used to move the second rail, whereby to change a length of a segment of the rear cord between a bottom edge of the first rail and a top edge of the second rail. In this way, the second rail could be turned along with the slats which are driven by the modulation shaft, and the problem of light leakage could be improved.

15 Claims, 20 Drawing Sheets

(56) References Cited

U.S. PATENT DOCUMENTS

| | | | | |
|---|---|---|---|---|
| 2016/0222722 | A1* | 8/2016 | Schulman | E06B 9/68 |
| 2017/0081912 | A1* | 3/2017 | Guillory | E06B 9/304 |
| 2017/0138123 | A1 | 5/2017 | Chen | |

FOREIGN PATENT DOCUMENTS

| | | | |
|---|---|---|---|
| FR | 2 823 790 | B1 | 3/2005 |
| JP | 2016-37838 | A | 3/2016 |

* cited by examiner

WINDOW BLIND

BACKGROUND OF THE INVENTION

1. Field of the Invention

The present invention relates generally to a window blind, and more particularly to a window blind which could ensure that the slats tightly overlap each other when the window blind is lowered and turned into a closure state.

2. Description of the Prior Art

FIG. 1 and FIG. 2 are lateral views of a conventional window blind, which includes a first rail 10, a second rail 20, and a plurality of slats 30. The slats 30 are evenly suspended between the first rail 10 and the second rail 20 through a ladder tape 40. A front cord and a rear cord are respectively hung on a front side and a rear side of the slats 30. Through the driving of the front cord 50 and the rear cord 60, the second rail 20 can be moved toward or away from the first rail 10, whereby to raise or lower the window blind. To stably move the second rail 20, the front cord 50 and the rear cord 60 are specifically designed that, when the window blind is fully lowered and the slats 30 are arranged in an open position, the lengths of the front and the rear cords 50, 60 exposed out of the first rail 10 are equal.

The ladder tape 40 mentioned above includes two warps 40*a* and a plurality of wefts 40*b*, wherein the two warps 40*a* respectively run through the front side and the rear side of the slats 30. An end of each of the warps 40*a* is connected to a drum 70 which is rotatably provided in the first rail 10, and another end of each of the warps 40*a* is connected to the second rail 20. The wefts 40*b* are provided between the warps 40*a* in a spaced-out manner, wherein each of two ends of each of the wefts 40*b* is respectively connected to the corresponding warp 40*a*. The wefts 40*b* bear the slats 30 on them. By controlling the drum 70 to rotate, the warps 40*a* can be driven to make a relative movement, with one going up and one going down, whereby to modulate the tilt angle of the slats 30. In this way, the window blind is able to allow different amounts of light to pass therethrough.

Multiple loops 40*c* are provided on the warps 40*a* of the ladder tape 40 in a spaced-out manner. The above-mentioned front cord 50 and rear cord 60 pass through the loops 40*c* on the respectively corresponding warps 40*a*, to which the front cord 50 and the rear cord 60 are adjacent thereby. An end of each of the front cord 50 and the rear cord 60 is connected to a power mechanism (not shown) provided in the first rail 10, while another end thereof is fixedly connected to the second rail 20, so that the front cord 50 and the rear cord 60 can bring the second rail 20 to move. The power mechanism can be a cord system or a bead chain system which can be pulled manually, a spring box which can provide mechanical power to retract the slat assembly, or an electrical control system which can provide a motorized rotating force. Herein, we take a spring box for example. The spring box provides a rewinding force to counter the weight of the second rail 20 and the slats 30, whereby to maintain equilibrium therebetween. Therefore, the second rail 20 can be held at any required position.

The mechanism controlling the lifting of the second rail 20 and the mechanism modulating the tilt angle of the slats 30 are two distinct mechanisms. Therefore, when the window blind is fully lowered and when the slats 30 are being turned into a closure state, the two warps 40*a* of the ladder tape 40 make a relative movement, with one going up and one going down, and approach each other. At this time, since the front cord 50 and the rear cord 60 are not controlled by the mechanism modulating the tilt angle of the slats 30, the second rail 20 is confined by the front cord 50 and the rear cord 60 which have equal lengths, and therefore cannot be turned to the same angle along with the slats. As a result, the bottom ends of the warps 40*a* of the ladder tape 40 are unable to approach each other as hindered by the second rail 20 which cannot be moved along with the slats 30. Meanwhile, the front cord 50 corresponding to the downward-turning side of the second rail 20 is taut, which might also interfere with the operation of the warps 40*a*, causing the slats 30 near the second rail 20 to have poor tightness, and therefore light leakage might occur there. In the condition mentioned above, the length of the rear cord 60 exposed out of the first rail 10 (i.e., the length of a segment of the rear cord 60 between the bottom edge of the first rail 10 and the second rail 20) is defined as an initial length L0.

SUMMARY OF THE INVENTION

In view of the above, one aspect of the present invention is to provide a window blind, which could ensure the slats have an excellent tightness between each other when the window blind is lowered and turned into a closure state.

The present invention provides a window blind, which includes a first rail, a second rail, a lifting module, a first cord, a second cord, a plurality of slats, a ladder tape, a modulation mechanism, and an adjustment unit. The lifting module is connected to the first rail. Each of the first cord and the second cord passes through and extends out of the first rail, and has an end connected to the lifting module and another end connected to the second rail. The slats are located between the first cord and the second cord. The ladder tape includes at least two warps, wherein the slats are suspended between the first rail and the second rail through the ladder tape, and the slats are located between the warps. The modulation mechanism is adapted to drive the warps of the ladder tape to make a relative movement in a vertical direction, whereby to drive the slats to turn between a first position and a second position. The adjustment unit is located between the lifting module and the slat, wherein the first cord passes through the adjustment unit. The first cord and the second cord are adapted to be driven to move the second rail toward or away from the first rail, whereby to raise or lower the slats. When the slats are fully lowered and are in the first position, a length of a segment of each of the first cord and the second cord between a bottom edge of the first rail and a top edge of the second rail is defined as a first length. When the slats are driven by the modulation mechanism to turn from the first position to the second position, the adjustment unit is driven to move the first cord, wherein, at this time, a length of a segment of the first cord between the bottom edge of the first rail and a top edge of the second rail is defined as a second length. The second length is different from the first length.

With the design above, when the modulation mechanism modulates the tilt angle of the slats, the adjustment unit is driven to rotate, and therefore to bring the rear cord to move. As a result, the length of the rear cord exposed out of the first rail could be changed. In this way, the lengths of the front cord and the rear cord exposed out of the first rail could be different, and therefore the second rail could be turned synchronously in accordance with the tilt angle of the slats turned by the ladder tape. Consequently, the problem of light leakage could be improved.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
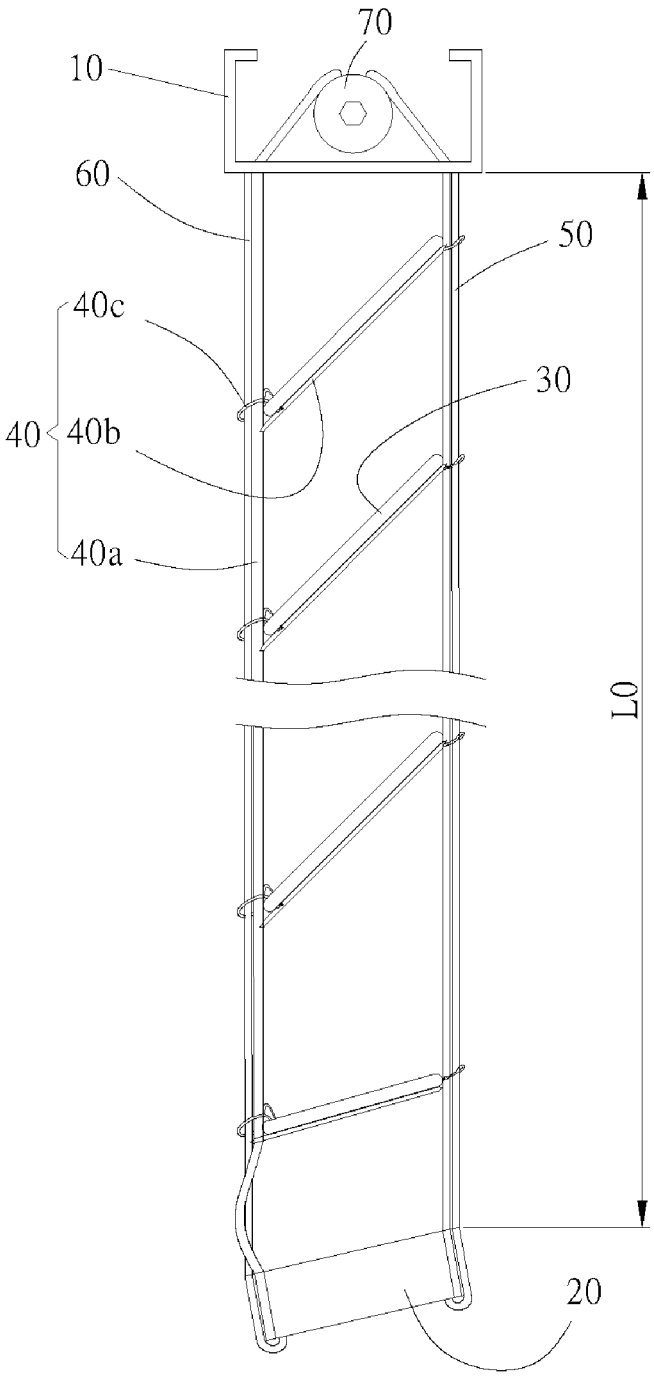
FIG. 1 (Prior Art)
FIG. 1 is a lateral view of a conventional window blind.
Figure 2:
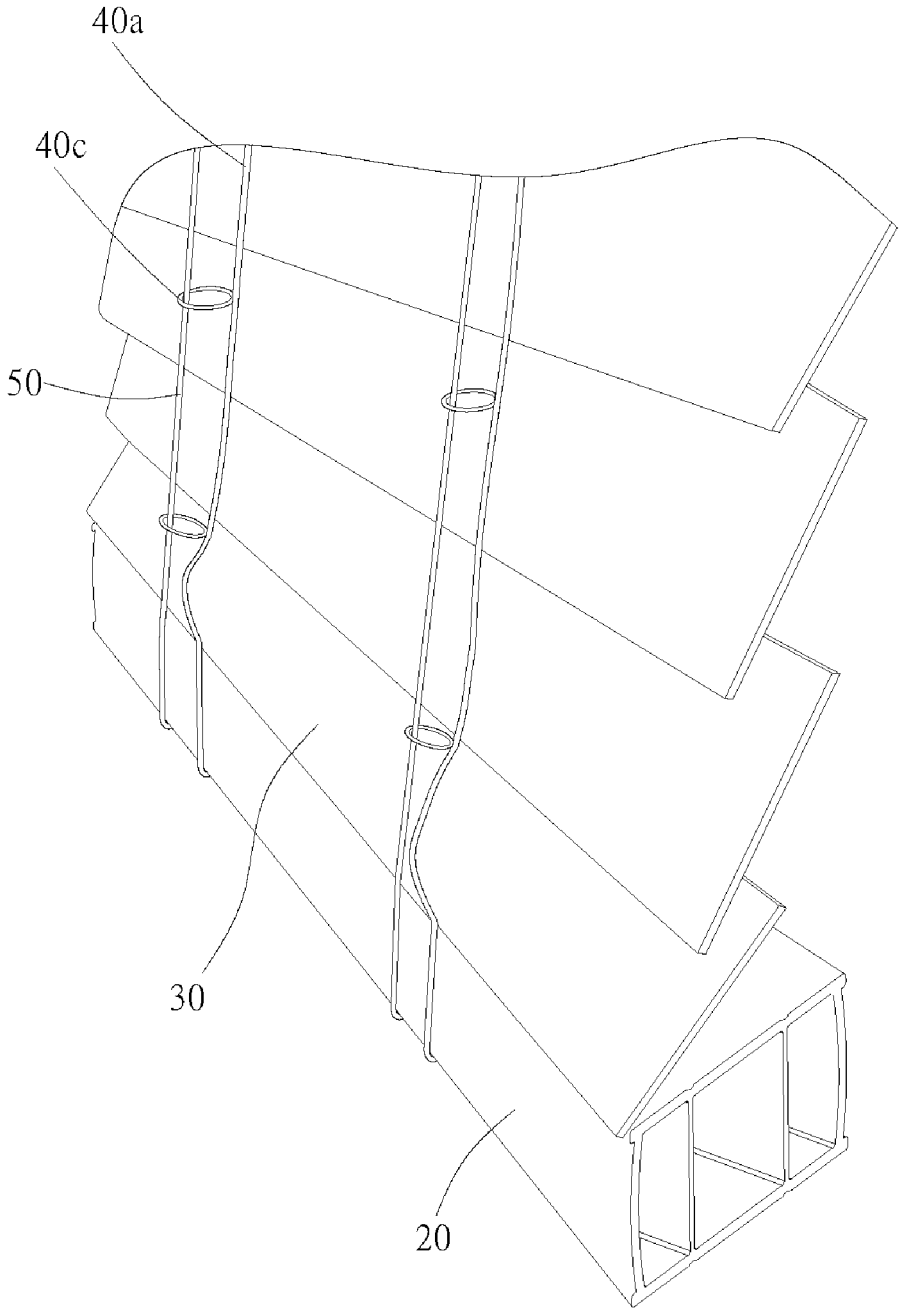
FIG. 2 (Prior Art)
FIG. 2 is a partial perspective view of the conventional window blind, showing the slats are turned.

A window blind 1 of a first embodiment of the present invention is shown in FIG. 3 to FIG. 6, which includes a first rail 11, a second rail 12, a plurality of slats 13, a ladder tape 14, a first cord, a second cord, a lifting module 2, a modulation mechanism 3, and an adjustment unit. The slats 13 are suspended in parallel between the first rail 11 and the second rail 12 through the ladder tape 14. The ladder tape 14 includes two warps 141 and a plurality of wefts 142, wherein the warps 141 respectively pass through a front side and a rear side of the slats 13. An end of each of the warps 141 is driven by the modulation mechanism 3, and another end thereof is connected to the second rail 12. The wefts 142 are provided between the warps 141 in a spaced-out manner. Furthermore, two ends of each of the wefts 142 are respectively connected to the warps 141, and each of the wefts 142 has one of the slats 13 carried thereon. Each of the warps 141 respectively has a plurality of loops 143 provided thereon. The loops 143 on one warp 141 are passed through by a front cord 15, while the loops 143 on the other warp 141 are passed through by a rear cord 16, whereby the front cord 15 and the rear cord 16 are respectively located at the front side and the rear side of the slats 13. Each of the front cord 15 and the rear cord 16, extending out of the first rail 11 and passing through the slats 13, is connected to the lifting module 2 and the second rail 12 with two opposite ends thereof. The second rail 12 can be moved by being driven by the front cord 15 and the rear cord 16, whereby to gather or spread the window blind 1. In the current embodiment, the second cord is the front cord 15, and the first cord is the rear cord 16. However, this designation is not a limitation of the present invention.

The lifting module 2 includes a power mechanism 21 therein, wherein the power mechanism is a cord or a bead chain system which can be manually maneuvered, or is a spring box or an electrical control system which can provide mechanical power to rewind the cords. In the current embodiment, the power mechanism is a spring box provided in the first rail 11 as an example, wherein the spring box includes a reel 211 and a pre-force device 212. In the current embodiment, each of the correspondingly-provided front cord 15 and rear cord 16, extending out of the first rail 11 and passing through the corresponding loops 143 on the ladder tape 14, is respectively connected to the same reel 211 of the power mechanism 21 with one of the ends thereof, while the other one of the ends thereof is fixedly connected to the second rail 12. The reel 211 is drivable to reel in or release the front cord 15 and the rear cord 16, whereby to move the second rail 12 toward or away from the first rail 11 through the front cord 15 and the rear cord 16, so as to gather or expand the slats 13. The pre-force device 212 and the reel 211 are connected, and their movements are linked, whereby to apply a rewinding force to the reel 211. Said rewinding force could maintain equilibrium with the weight of the second rail 12 and the slats 13, so that the second rail 12 could stay at any required position.

In the current embodiment, the modulation mechanism 3 includes a modulation shaft 31 provided in the first rail 11 and a rotatable rod 33 provided outside of the first rail 11. The modulation shaft 31 is rotatably provided in the first rail 11 in a longitudinal axial direction of the first rail 11, and can be controlled by the rotatable rod 33, whereby to drive the warps 141 of the ladder tape 14 to make a relative vertical movement. Two ends of each of the wefts 142 of the ladder tape 14 have a relative movement as well, so that a tilt angle of the slats supported by the wefts 142 can be adjusted.

Figure 7:
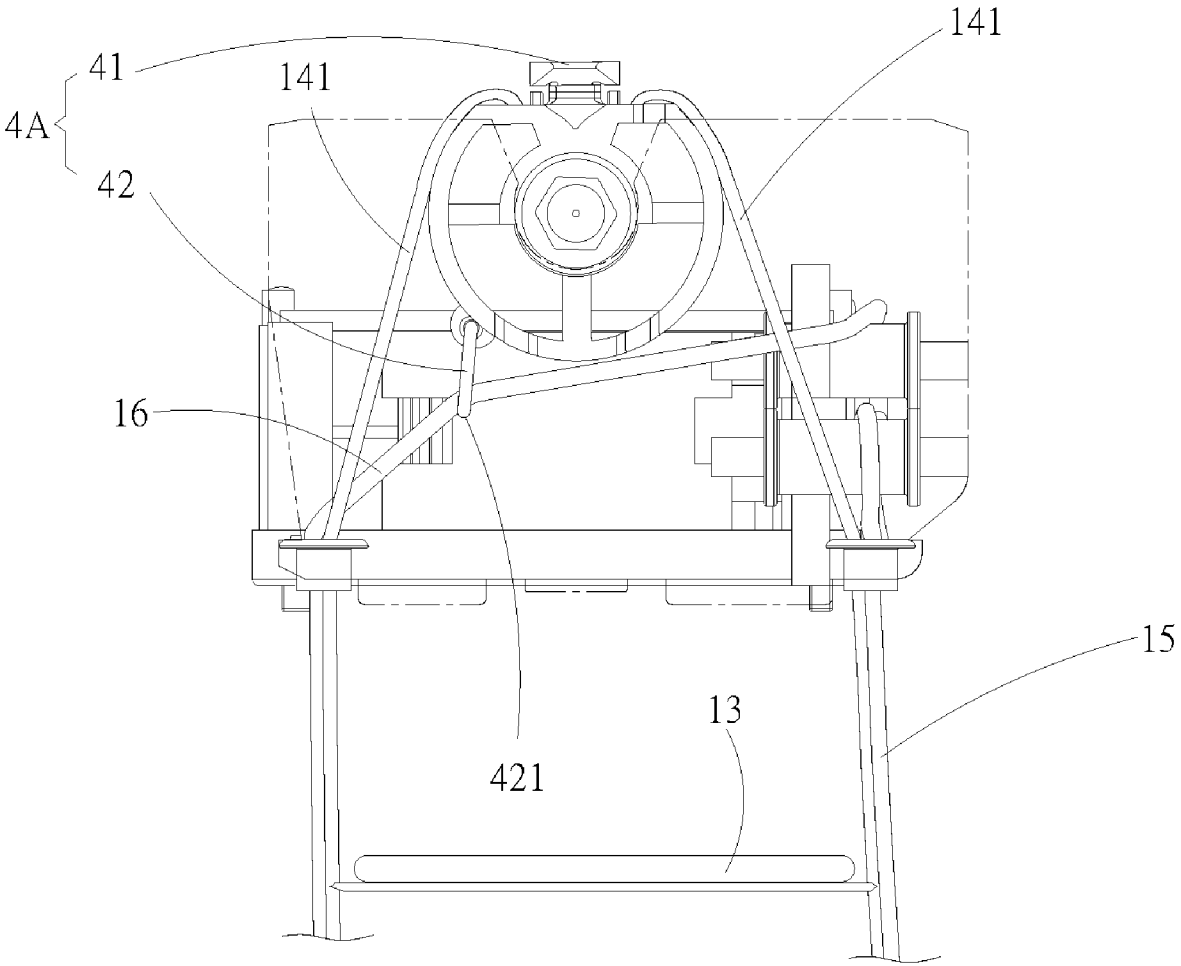
FIG. 7 is a lateral view of FIG. 6.

As shown in FIG. 7, the adjustment unit 4A of the current embodiment includes a rotary seat 41 and an interference member, wherein the rotary seat 41 is fixedly provided on the modulation shaft 31, and therefore can be driven to rotate by the modulation shaft 31. The interference member is a cord ring 42, which is pivotably provided on the rotary seat 41. The cord ring 42 further has a limiting segment 421. The rear cord 16 passes through the cord ring 42 in a non-tangled manner, extends out of the first rail 11, and passes through the slats 13, with an end thereof connected to the reel 211 and another end therefor is connected to the second rail 12. Whereby, the cord ring 42 can be rotated along with the rotary seat 41, moving the rear cord 16 to change a length of the rear cord 16 exposed out of the first rail 11. It is also worth mentioning that, one of the ends of each of the warps 141 of the ladder tape 14 can be connected to the rotary seat 41. In this way, when the rotary seat 41 is driven to rotate by the modulation shaft 31, the warps 141 can be driven to make a relative movement in a vertical direction.

In the current embodiment, the cord ring 42 can pivot on the rotary seat 41. In other words, the rotary seat 41 can drive the cord ring 42 to move, so that the limiting segment 421 of the cord ring 42 can pivot along with the rotation of the rotary seat 41. When the modulation shaft 31 drives the rotary seat 41 to rotate toward the front side of the window blind 1, the cord ring 42 pivots and the limiting segment 421 presses upon the rear cord 16 passing through the cord ring 42, whereby to move the rear cord 16 at the same time.

In the above paragraphs, we have described the structures of the window blind 1 of the first embodiment of the present invention. In the condition shown in FIG. 3 and FIG. 4, the window blind 1 is fully lowered, and the slats 13 are adjusted to a horizontal arrangement, wherein a distance between any two neighboring slats 13 is the longest, and therefore the window blind 1 allows the most amount of light to pass through. The slats in such condition is defined as located at a first position P1; the length of the rear cord 16 exposed out of the first rail 11 (i.e., the length of a segment of the rear cord 16 between a bottom edge of the first rail 11 and a top edge of the second rail 12) is defined as a first length L1. At this time, the length of a segment of the front cord 15 between the bottom edge of the first rail 11 and the top edge of the second rail 12 equals the first length L1.

Figure 8:
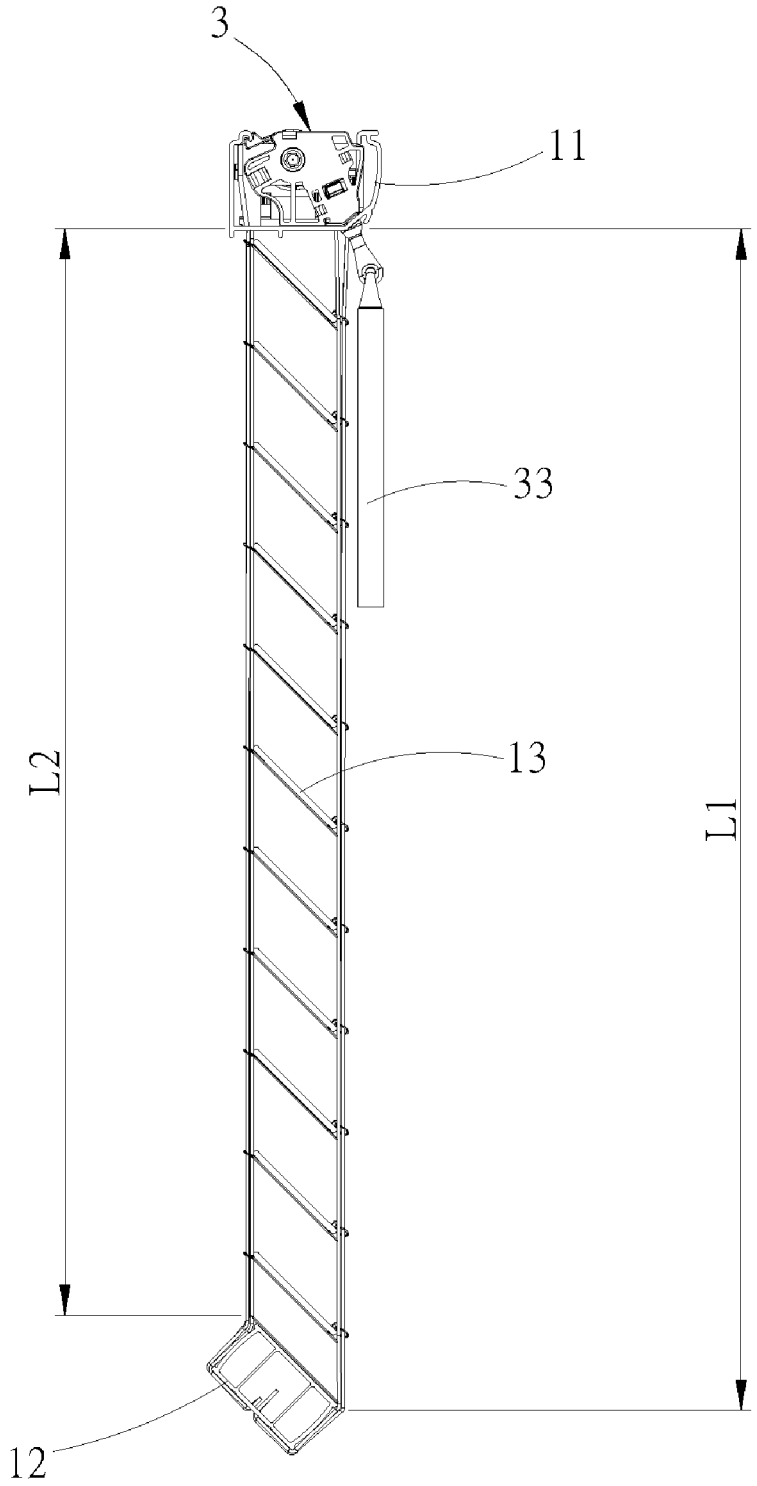
FIG. 8 is a lateral view of the window blind of the aforementioned embodiment of the present invention, showing the slats are at the second position.
Figure 9:
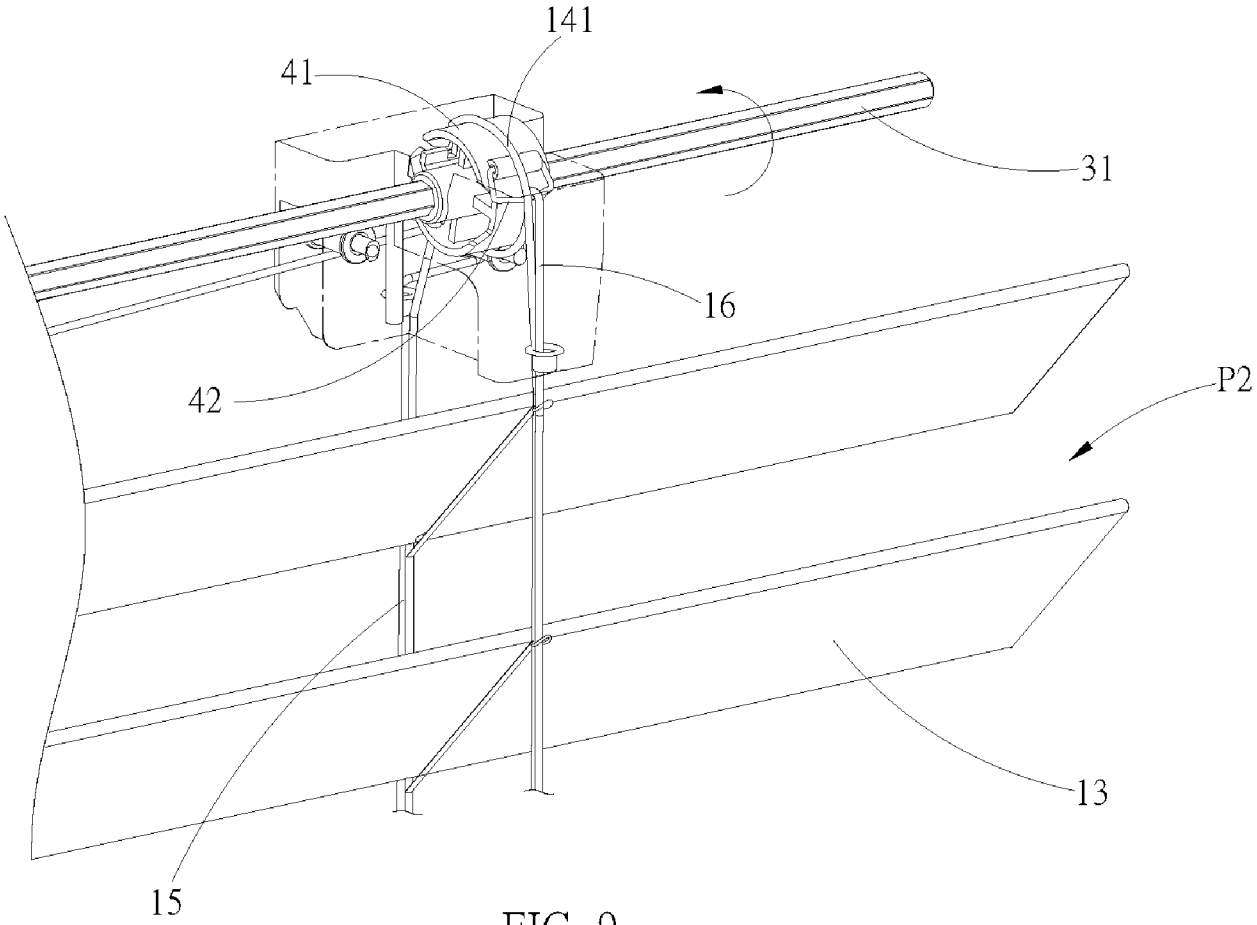
FIG. 9 is a partial perspective view of the window blind of the aforementioned embodiment of the present invention.
Figure 10:
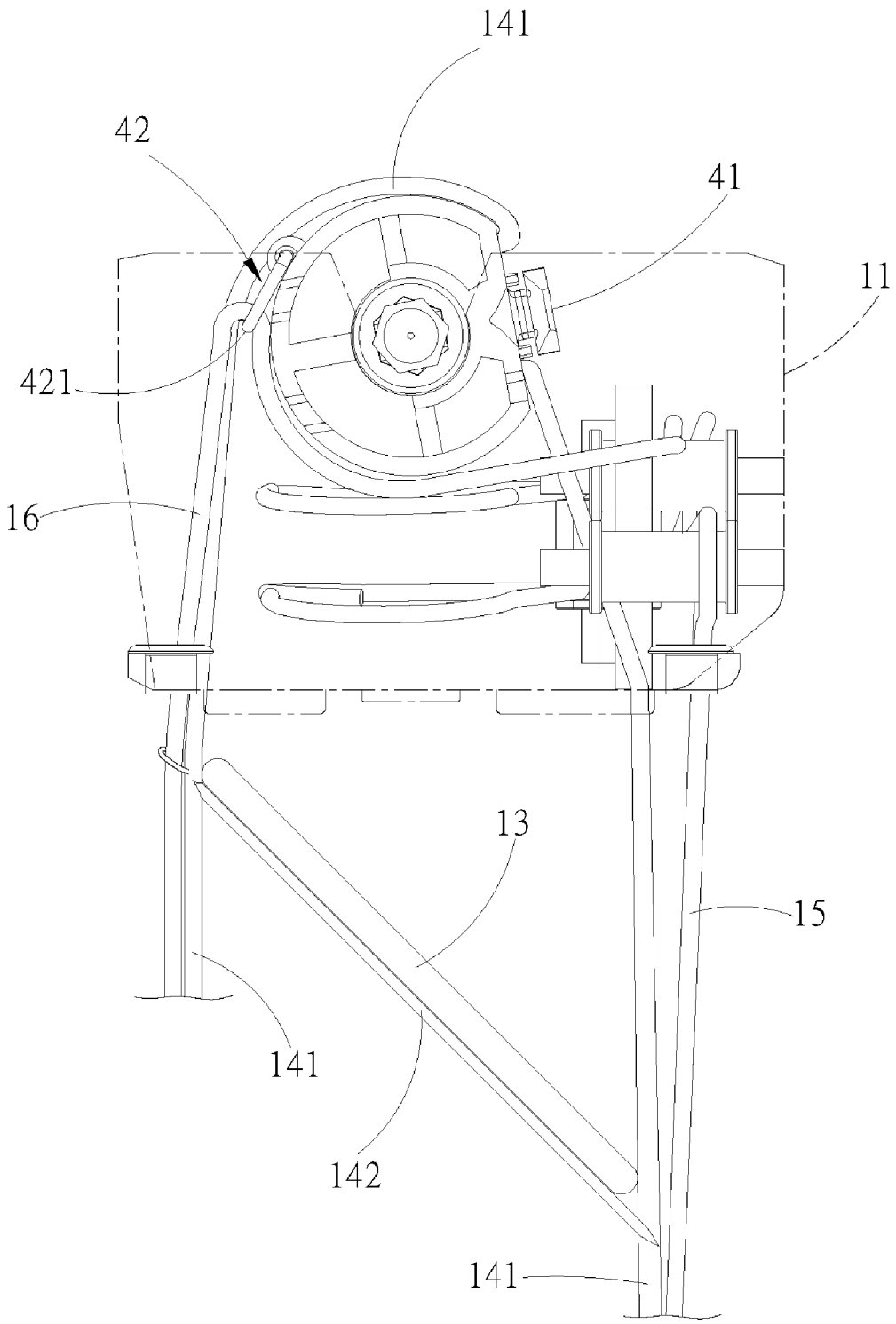
FIG. 10 is a lateral view of FIG. 9.
Figure 11:
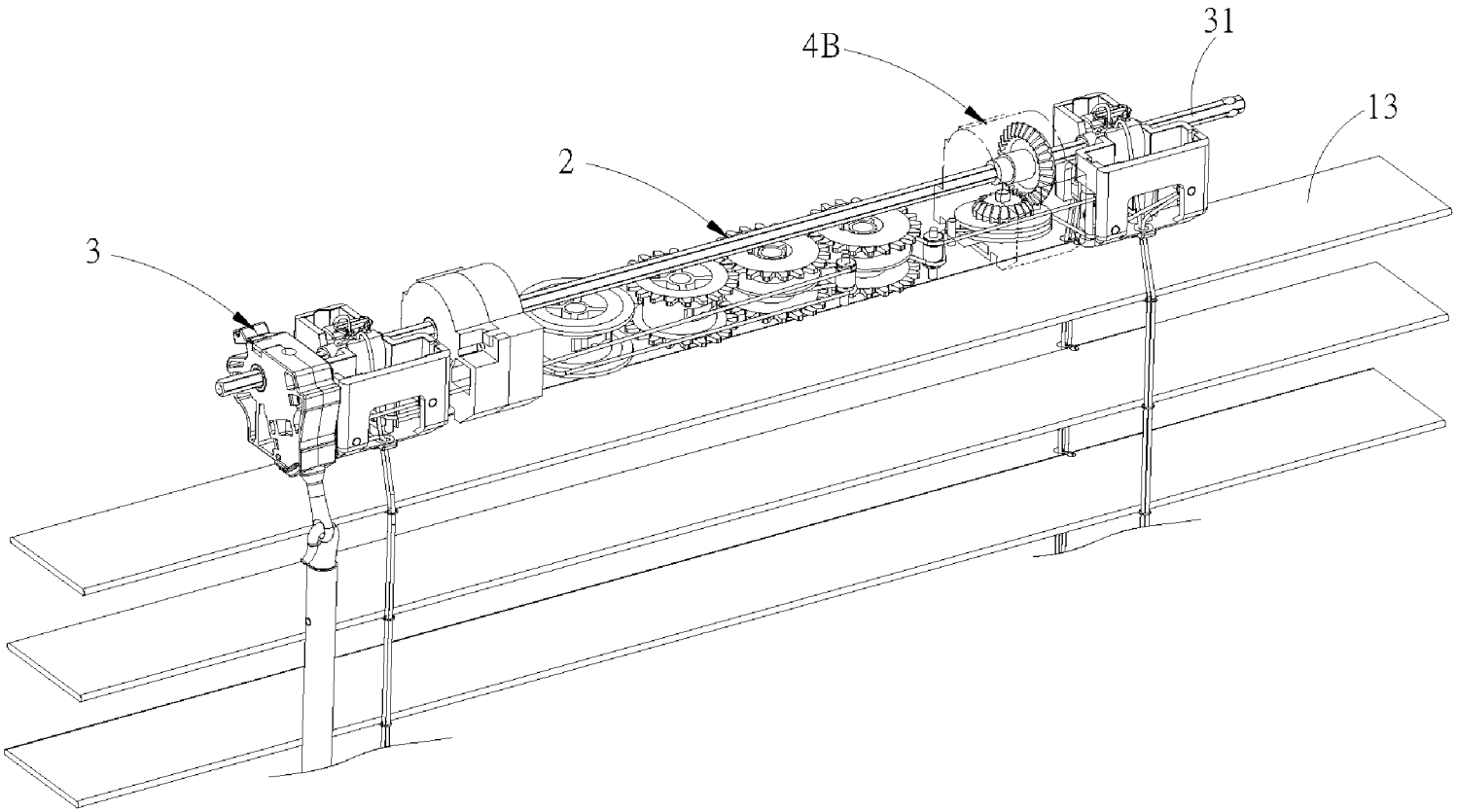
FIG. 11 is a partial perspective view of a window blind of a second embodiment of the present invention.
Figure 12:
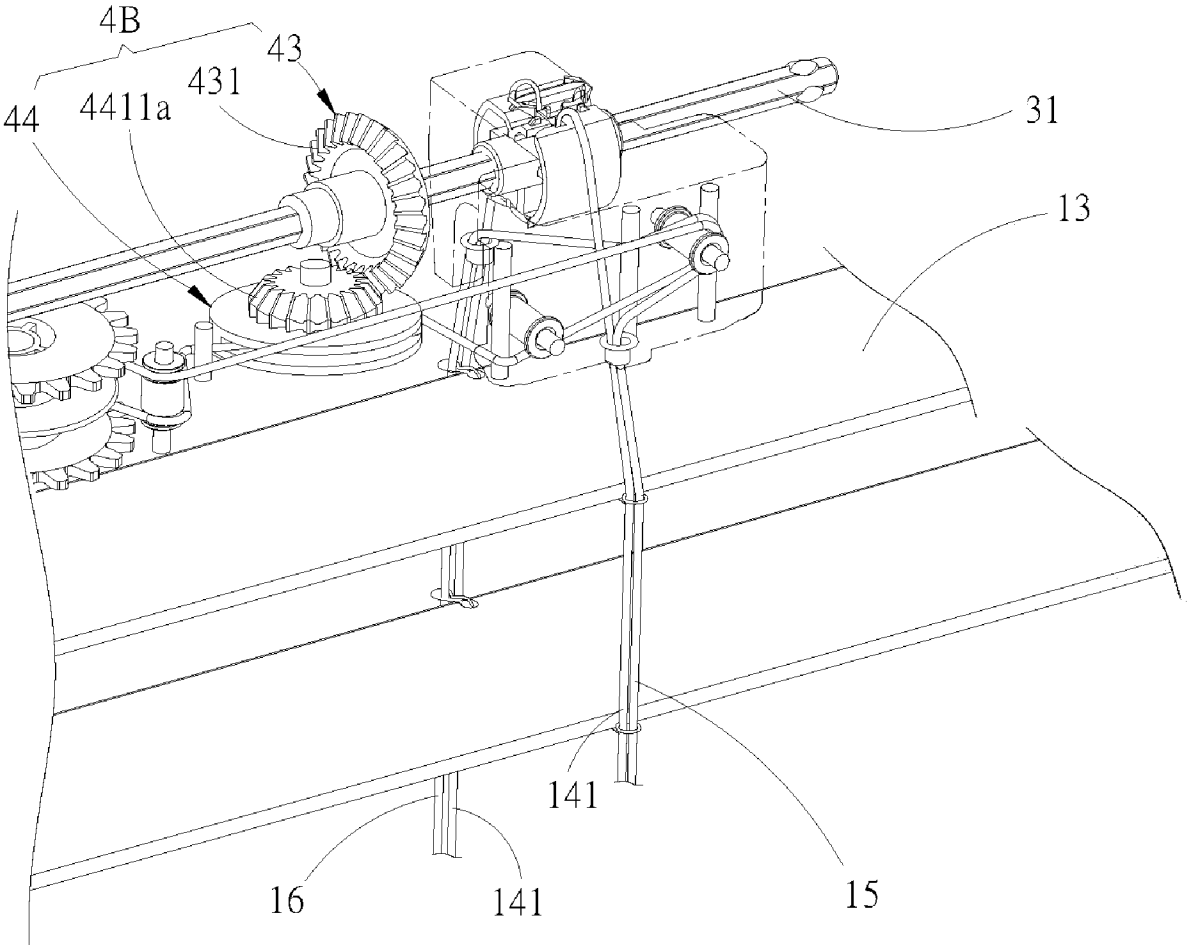
FIG. 12 is an enlarged partial perspective view of FIG. 11.

As shown in FIG. 8 to FIG. 10, when a user maneuvers the rotatable rod 33 of the modulation mechanism 3 to rotate the modulation shaft 31, driving the rotary seat 41 to rotate toward the front side of the window blind 1, the modulation mechanism drives the warps 141 of the ladder tape 14 to make a vertical relative movement. The warps 141 approach each other, and the wefts 142 connected between the warps 141 tilt consequently, driving the slats 13 to turn from the first position P1 toward the second position P2. At the same time, along with the rotation of the rotary seat 41 driven by the modulation shaft 31, the cord ring 42 is driven by the rotary seat 41 to change its position. The cord ring 42 also presses upon the rear cord 16 with the limiting segment 421 thereof, driving the rear cord 16 to move. During the movement, the rear cord 16 would be twisted, so that the segment of the rear cord 16 exposed out of the first rail 11 would be brought upward, whereby to change the length thereof. At this time, a length of a segment of the rear cord 16 between the bottom edge of the first rail 11 and the top edge of the second rail 12 is defined as a second length L2, wherein the second length L2 is less than the first length L1.

As shown in FIG. 8, when the rotary seat 41 is driven by the modulation shaft 31 to rotate toward the front side of the window blind 1, and when the slats 13 are turned to the closed second position P2 as being driven by the ladder tape 14, the rear cord 16 of the current embodiment is driven by the cord ring 42 and gets twisted, so that the second length L2, i.e., the length of the segment of the rear cord 16 between the bottom edge of the first rail 11 and the top edge of the second rail 12, would be less than a length of a segment of the front cord 15 between the bottom edge of the first rail 11 and the top edge of the second rail 12. The front side and the rear side of the second rail 12 could be respectively driven by the front cord 15 and the rear cord 16 of different lengths, and the front cord 15 and the rear cord 16 would be both taut. As a result, the second rail 12 could be turned to the same angle with that of the slats 13 simultaneously, and therefore the warps 141 of the ladder tape 14 passing through the second rail 12 would approach each other.

Herein we compare FIG. 1 to FIG. 8. When the slats 30 are turned into a closure state as shown in FIG. 1, the second rail 20 cannot be turned, and the warps 40*a* of the ladder tape 40 cannot approach each other, for the exposed segments of the front cord 50 and the rear cord 60 have the same lengths, and the front cord 50 is taut. Whereas, in FIG. 8, when the slats are turned to be closed, the exposed segment of the rear cord 16 has a different length from that of the exposed segment of the front cord 15. By turning the second rail 12 with cords of different lengths, the warps 141 of the ladder tape 14 approach each other, and therefore the second rail 12 and the slats 13 could have a better closure effect therebetween, which would improve the problem of light leakage.

Figure 14:
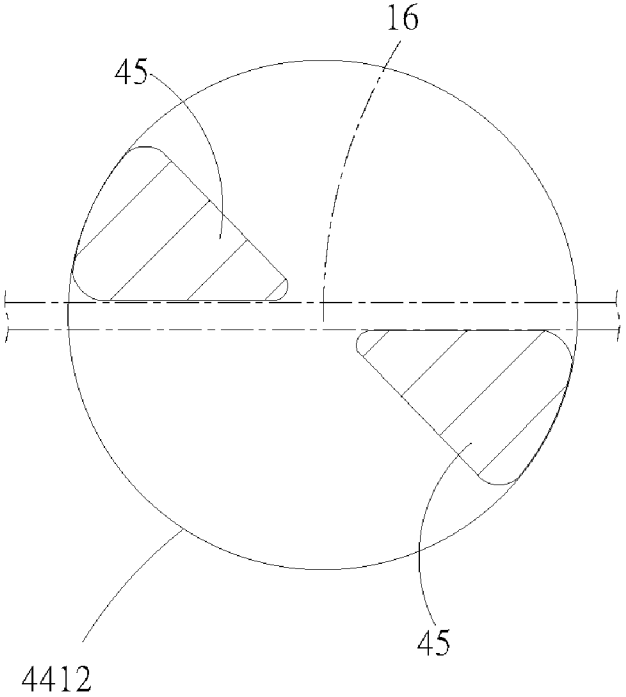
FIG. 14 is a sectional view along the 14-14 line in FIG. 13.
Figure 13:
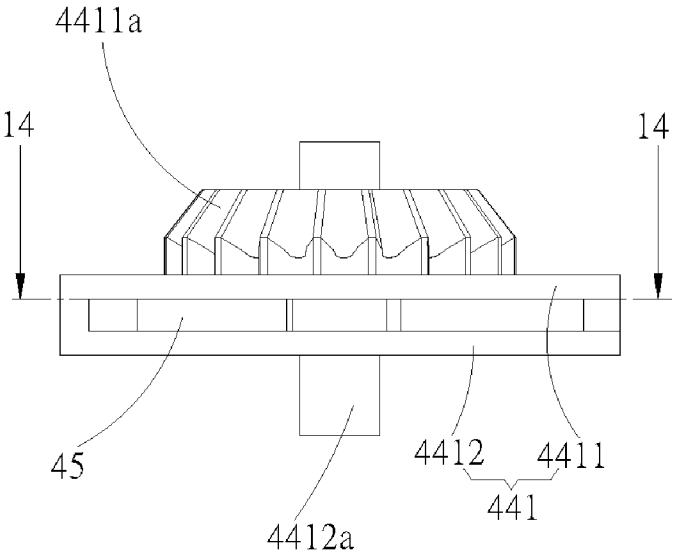
FIG. 13 is a lateral view of the rotary disc of the rotary seat of the window blind of the aforementioned second embodiment of the present invention.

A window blind of a second embodiment of the present invention is shown in FIG. 11 to FIG. 14. Like the aforementioned embodiment, the window blind of the second embodiment also includes a first rail 11 (not shown), a second rail 12 (not shown), a plurality of slats 13, a lifting module 2, and a modulation mechanism 3. The difference from the embodiment mentioned above is that, an adjustment unit 4B included in the window blind of the second embodiment includes a transmission gear 43 and a rotary seat 44, wherein the transmission gear 43 is fixedly provided on the modulation shaft 31 of the modulation mechanism 3, so that the transmission gear 43 can be driven to rotate by the modulation shaft 31. The transmission gear 43 has a first bevel teethed portion 431. In the current embodiment, the rotary seat 44 includes a rotary disc 441, which is formed by correspondingly combing an upper disc body 4411 and a lower disc body 4412, which are separated by a distance. With a shaft 4412*a* provided on a bottom of the lower disc body 4412, the rotary disc 441 is rotatably provided in the first rail 11. The upper disc body 4411 has a second bevel teethed portion 4411*a* provided on a top surface thereof, wherein the second bevel teethed portion 4411*a* meshes with the first bevel teethed portion 431 of the transmission gear 43. In the current embodiment, the interference member is two blocks 45 correspondingly provided in the rotary disc 441. Each of the blocks 45 is fixedly engaged between a bottom surface of the upper disc body 4411 and the top surface of the lower disc body 4412, and is not located at a rotating center of the rotary disc 441. The rear cord 16 passes through the space between the upper disc body 4411 and the lower disc body 4412, and extends out of the first rail 11. Furthermore, the rear cord also passes through the correspondingly-provided blocks 45 as shown in FIG. 14. In addition, an end of the rear cord 16 is connected to the reel 211 of the power mechanism 21.

Figure 3:
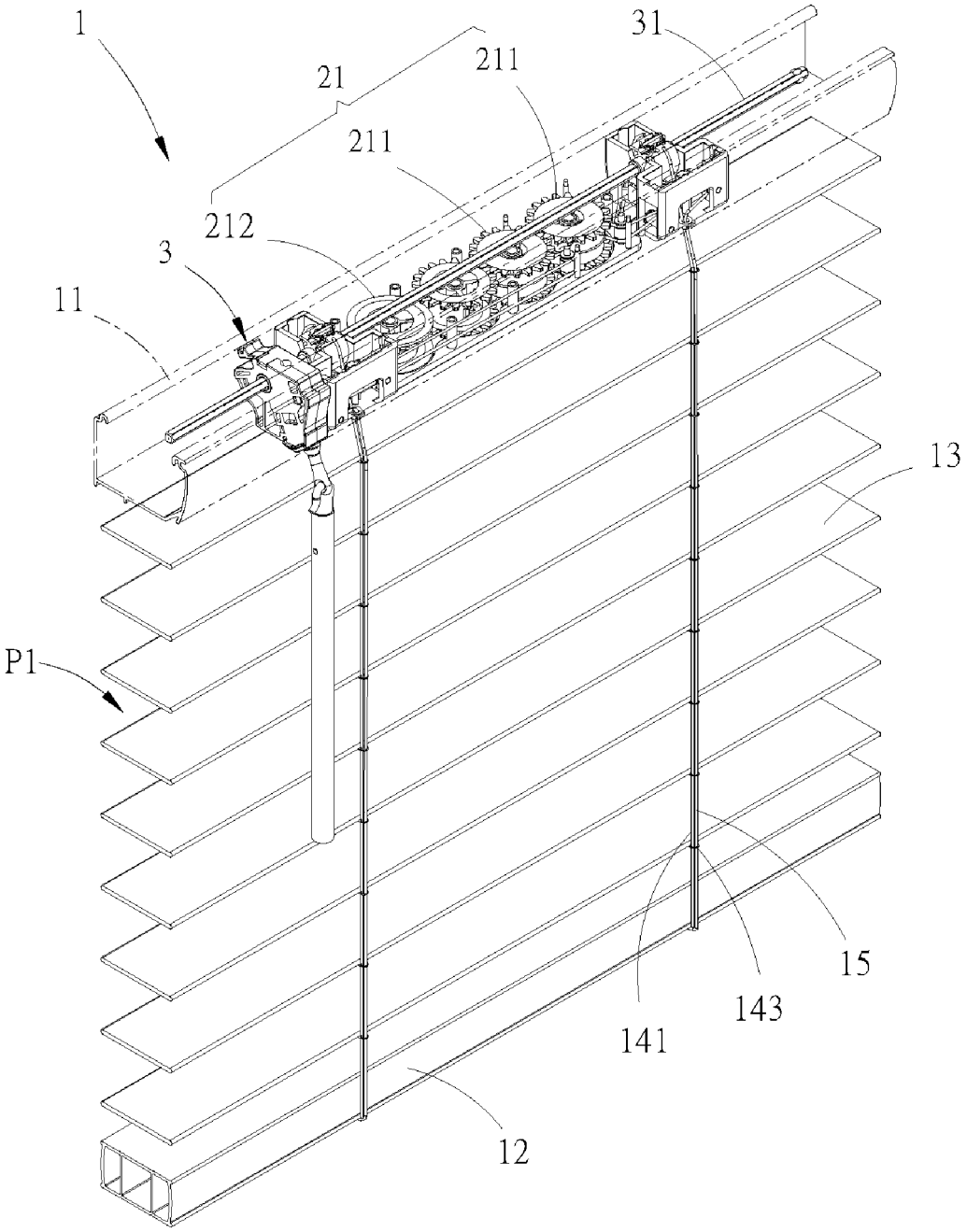
FIG. 3 is a perspective view of a window blind of a first embodiment of the present invention.
Figure 4:
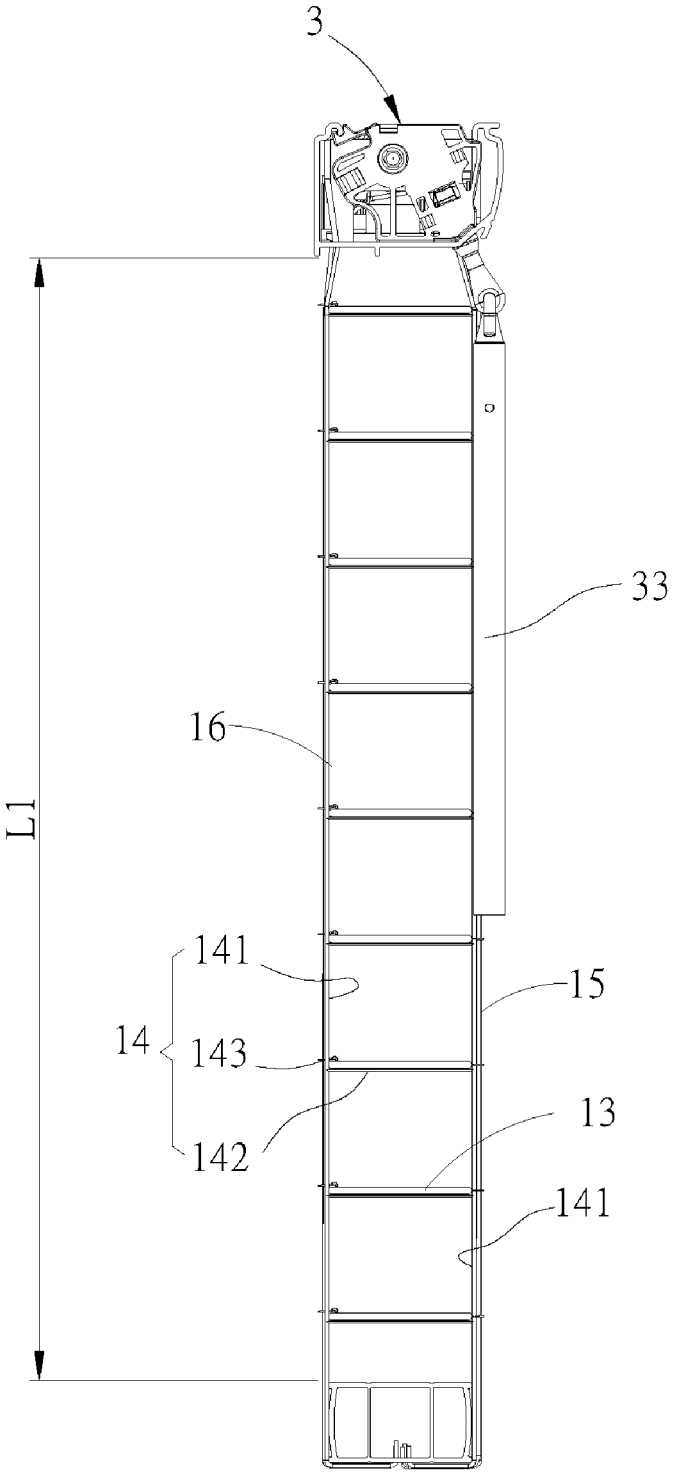
FIG. 4 is a lateral view of the window blind shown in FIG. 3, showing the slats are at the first position.
Figure 5:
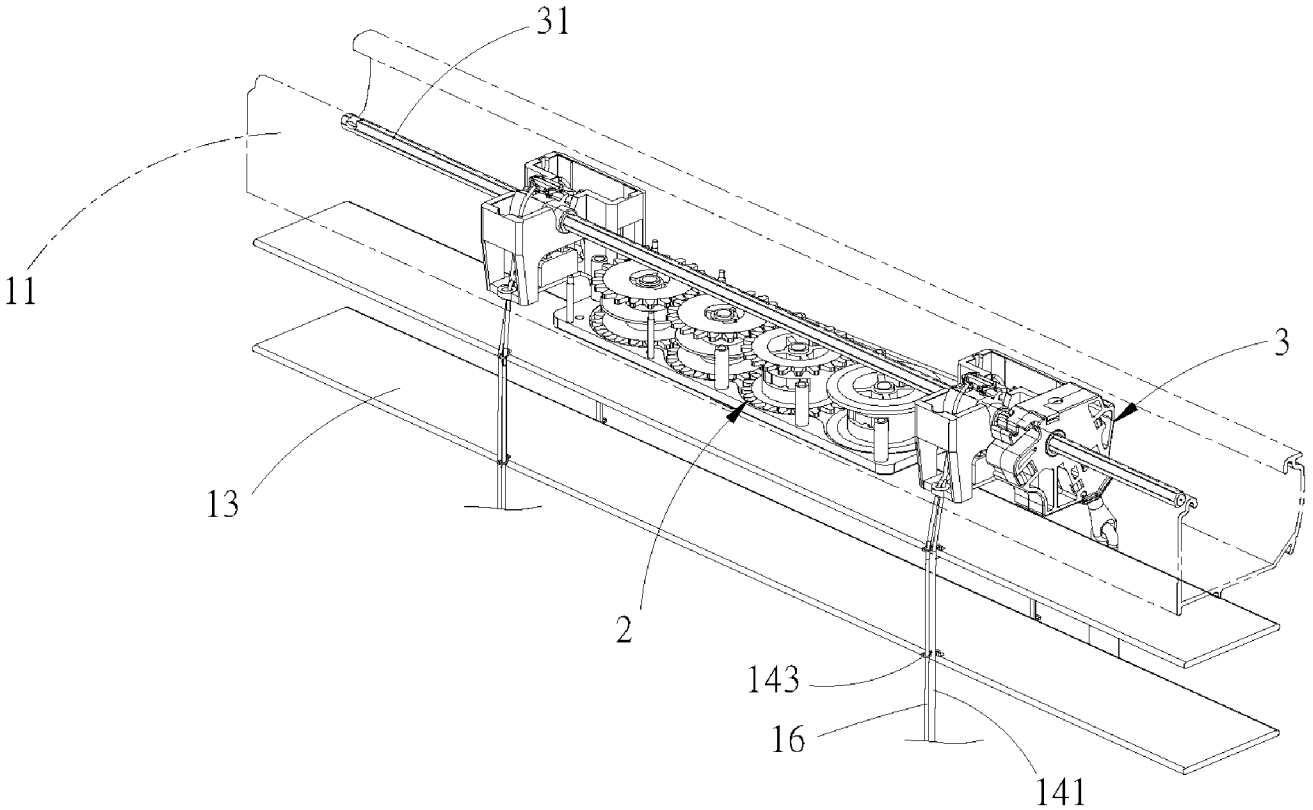
FIG. 5 is a partial perspective view of the window blind of the aforementioned embodiment of the present invention.
Figure 6:
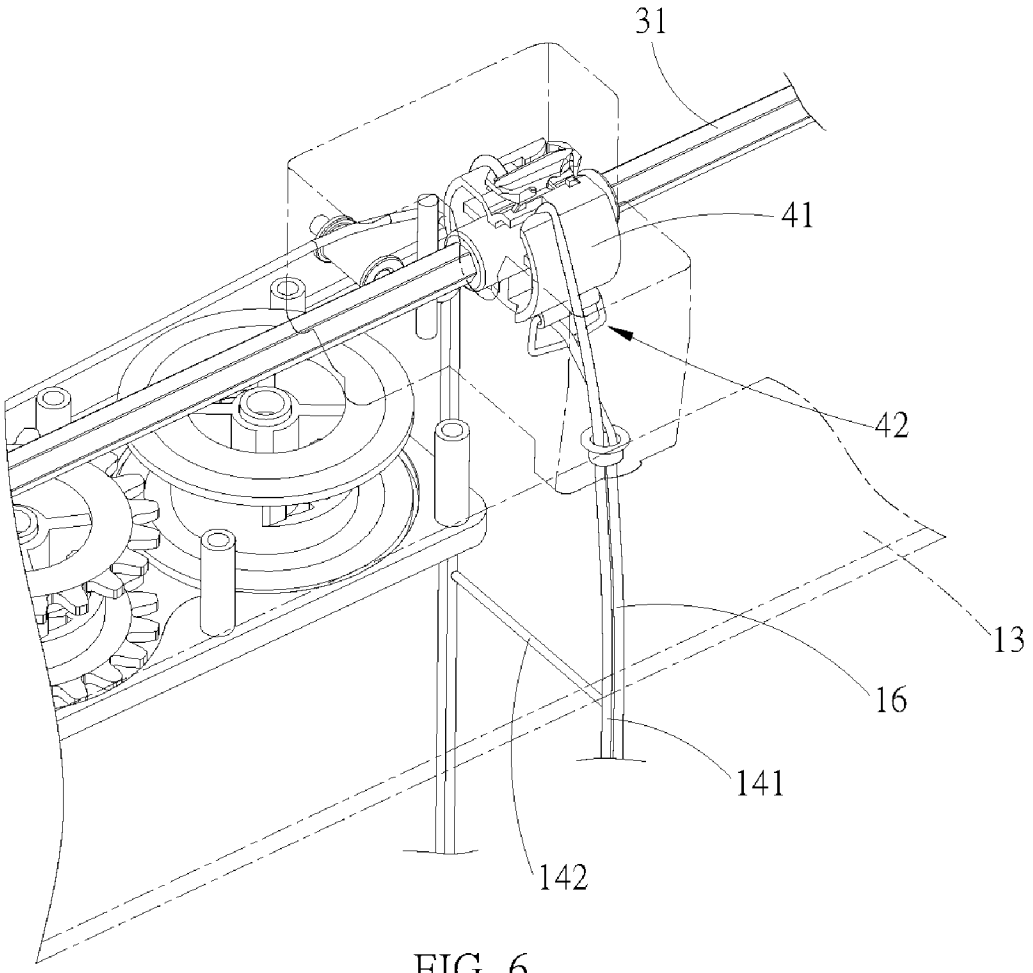
FIG. 6 is an enlarged partial view of FIG. 5.
Figure 15:
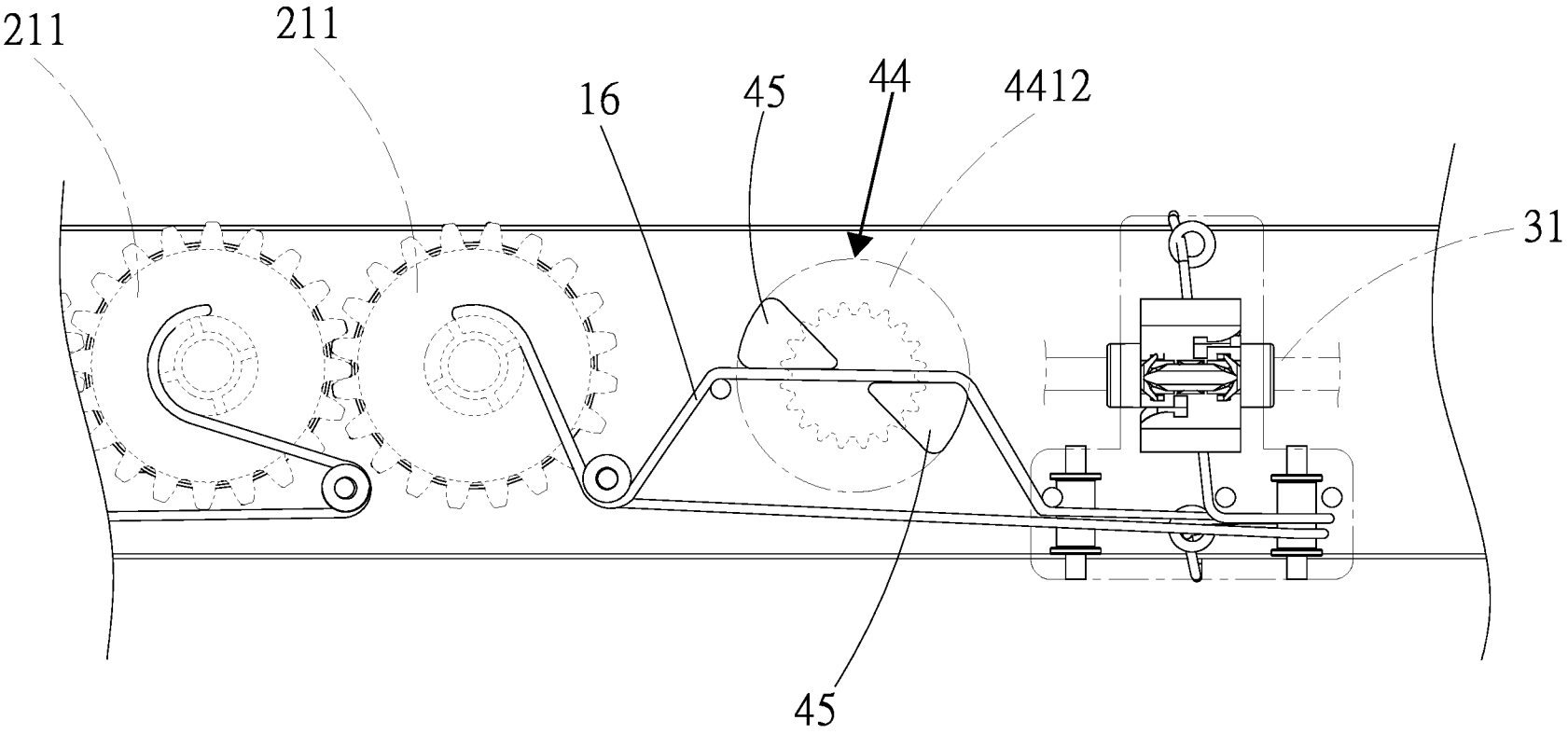
FIG. 15 is a top view of the window blind of the aforementioned second embodiment of the present invention, showing the condition when the rotary disc is not turned.
Figure 16:
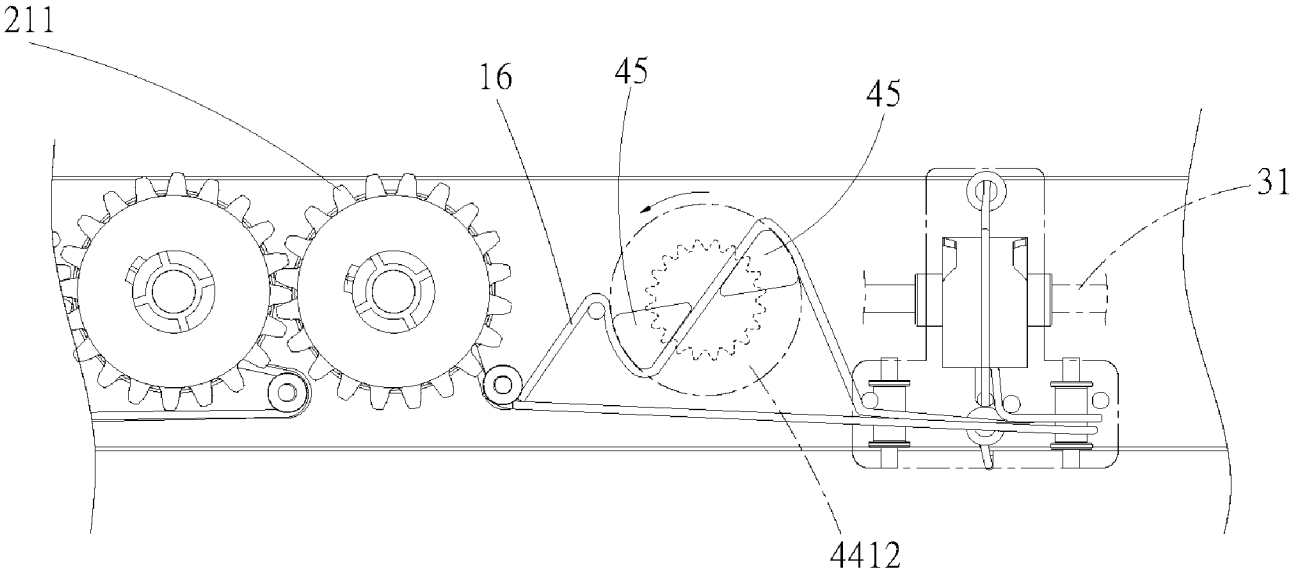
FIG. 16 is a top view of the window blind of the aforementioned second embodiment of the present invention, showing the condition when the rotary disc is turned.

The status of the rotary seat 44 illustrated in FIG. 15 is the status when the window blind is fully lowered and the slats 13 are at the first position P1 (i.e., are horizontally arranged, as the slats 13 shown in FIG. 3). At this time, the rear cord 16 directly passes through the rotary disc 441, wherein the segment of the rear cord 16 inside the rotary disc 441 is straight. The length of the segment of the rear cord 16 exposed out of the first rail 11 (i.e., the segment of the rear cord 16 between the bottom edge of the first rail 11 and the top edge of the second rail 12) is the first length L1. Meanwhile, the segment of the front cord 15 between the bottom edge of the first rail 11 and the top edge of the second rail 12 also equals the first length L1. The condition shown in FIG. 16 is the condition when the modulation shaft 31 is driven to rotate, and the slats 13 are turned to the second position P2, rendering a closure status as shown in FIG. 9. At this time, the transmission gear 43 is driven to rotate by the modulation shaft 31, and the rotary disc 441 is synchronically rotated through the meshing relationship between the first bevel teethed portion 431 and the second bevel teethed portion 4411*a*. Along with the rotation of the rotary disc 441, the blocks 45 is moved to push the rear cord 16, whereby the rear cord 16 is twisted along the blocks 45. Therefore, a part of the segment of the rear cord 16 exposed out of the first rail 11 is drawn in the first rail 11. At this time, the length of the segment of the rear cord 16 between the bottom edge of the first rail 11 and the top edge of the second rail 12 is the second length L2, wherein the second length L2 is less than the first length L1. Thus, the adjustment unit of the current embodiment, which is composed by providing the transmission gear 43 and the rotary seat 44, could be also driven by the modulation mechanism 3. With such design, when the rotation of the modulation mechanism 3 drives the slats 13 to turn from the first position P1 to the second position P2, the adjustment unit synchronically drives the rear cord 16 to move upward, whereby to change the length of the segment of the rear cord 16 exposed out of the first rail 11. In this way, the second rail 12 could be turned in accordance with the tilt angle of the slats 13 turned by the ladder tape 14, and the warps 141 of the ladder tape 14 could approach each other, whereby to improve the problem of light leakage.

Figure 17:
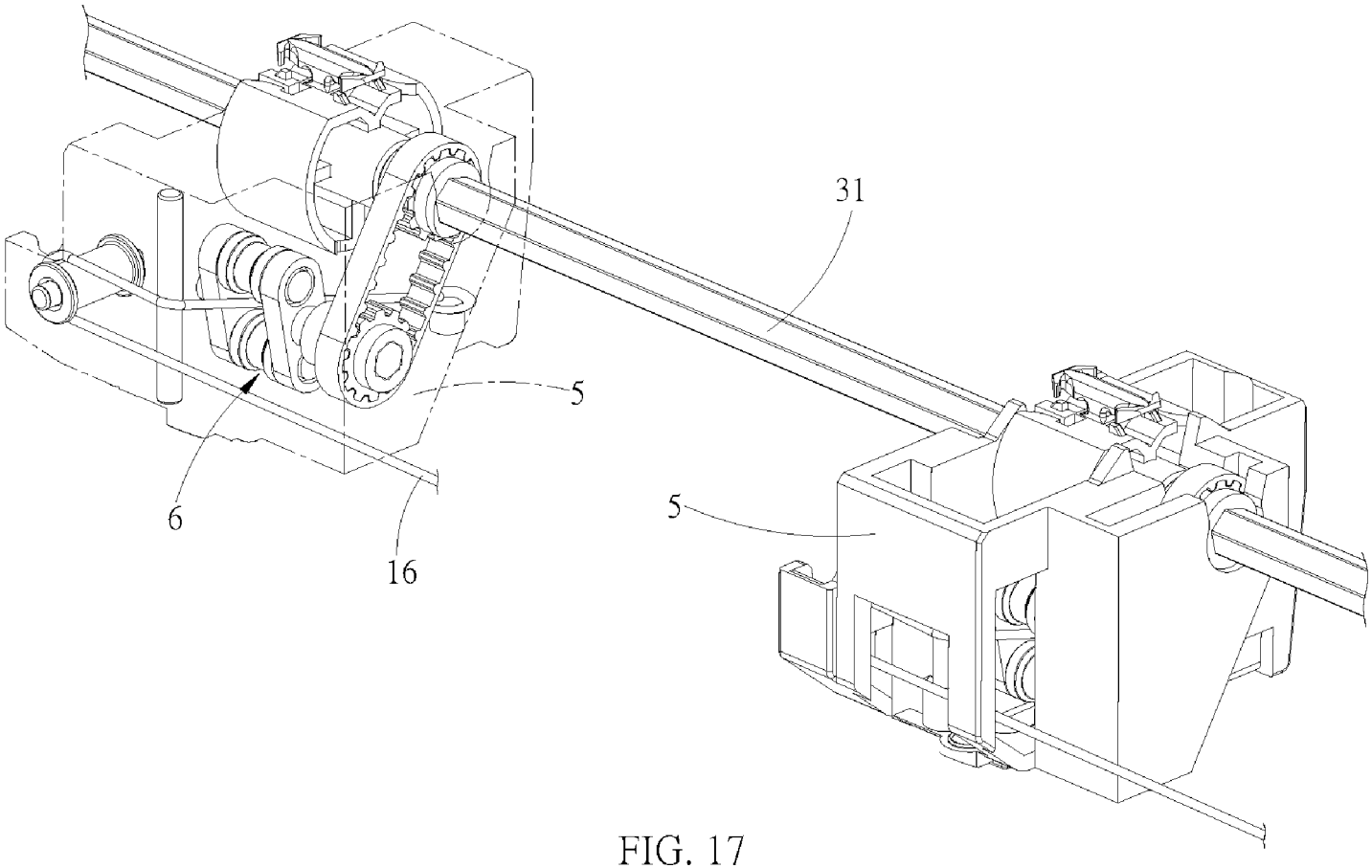
FIG. 17 is a partial perspective view of a window blind of a third embodiment of the present invention.
Figure 18:
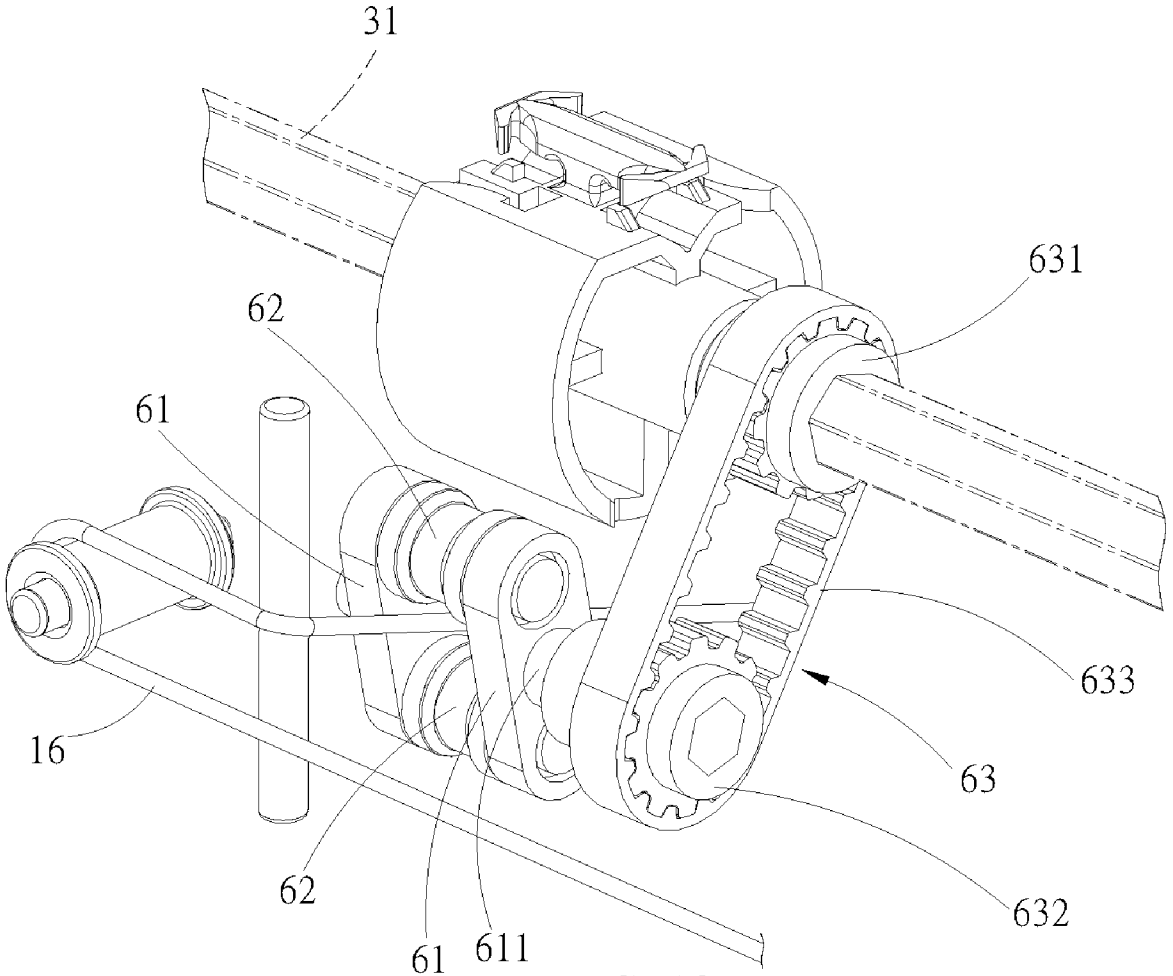
FIG. 18 is an enlarged partial perspective view of the aforementioned third embodiment of the present invention, illustrating the condition when the modulation shaft is not rotated.

Part of the structures of a window blind of a third embodiment of the present invention is illustrated in FIG. 17 and FIG. 18, showing that the window blind includes the modulation shaft 31 of the modulation mechanism 3 provided in the first rail 11 (not shown), and a base case 5. An adjustment unit 6 of the current embodiment is provided in the base case 5, wherein the adjustment unit 6 includes a rotary seat 61, an interference member 62, and a transmission assembly 63.

Figure 19:
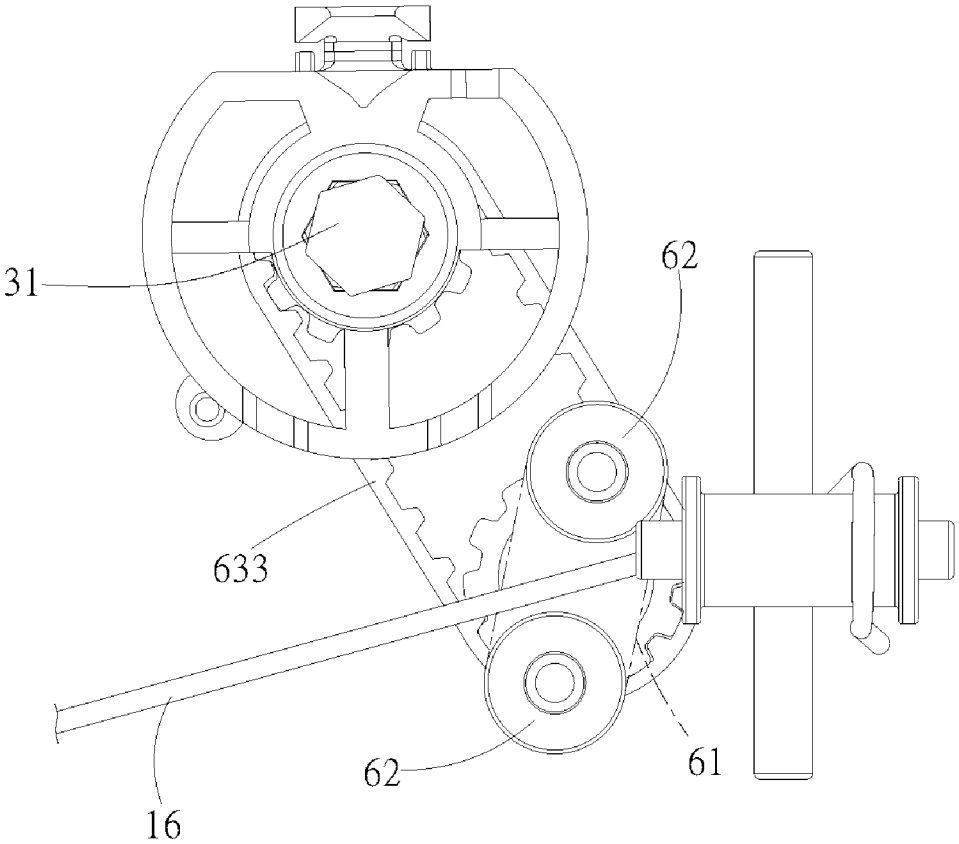
FIG. 19 is a left side view of FIG. 18.

As shown in FIG. 18 and FIG. 19, the rotary seat 61 is a swing arm which is substantially long and plate-like, and the interference member 62 is a cylindrical pressing wheel. In the current embodiment, there are two corresponding rotary seats 61 and two corresponding interference members 62, which together form a frame-like structure. Each of the rotary seats 61 has a pivot 611 on a side thereof, and is received in the base case 5 through said pivot 611 on the side, so that the rotary seats 61 are rotatably provided in the first rail 11. The rear cord 16 passes through the frame-like structure and the space between the corresponding interference members 62.

The transmission assembly 63 of the adjustment unit 6 is linked to the modulation shaft 31, and the transmission assembly 63 is also connected to and linked to the rotary seat 61. In the current embodiment, the transmission assembly 63 includes a driving gear 631, a driven gear 632, and a transmission belt 633. The driving gear 631 is fixedly provided on the modulation shaft 31, and the driven gear 632 is fixedly provided on the pivot 611 of one of the rotary seats 61. The transmission belt 633 is respectively connected to and linked to the driving gear 631 and the driven gear 632.

Figure 20:
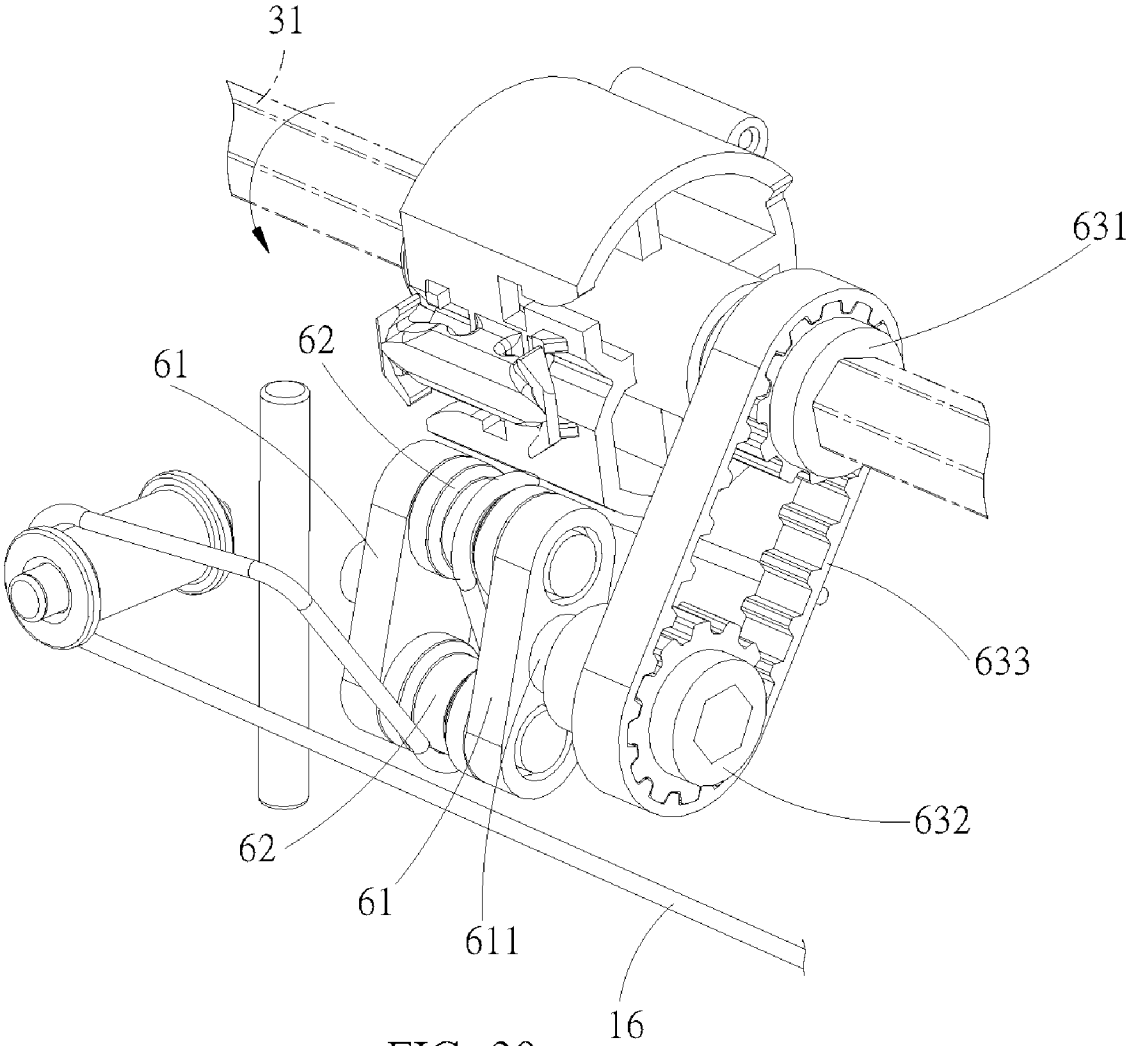
FIG. 20 is similar to FIG. 18, illustrating the condition when the modulation shaft is being rotated.
Figure 21:
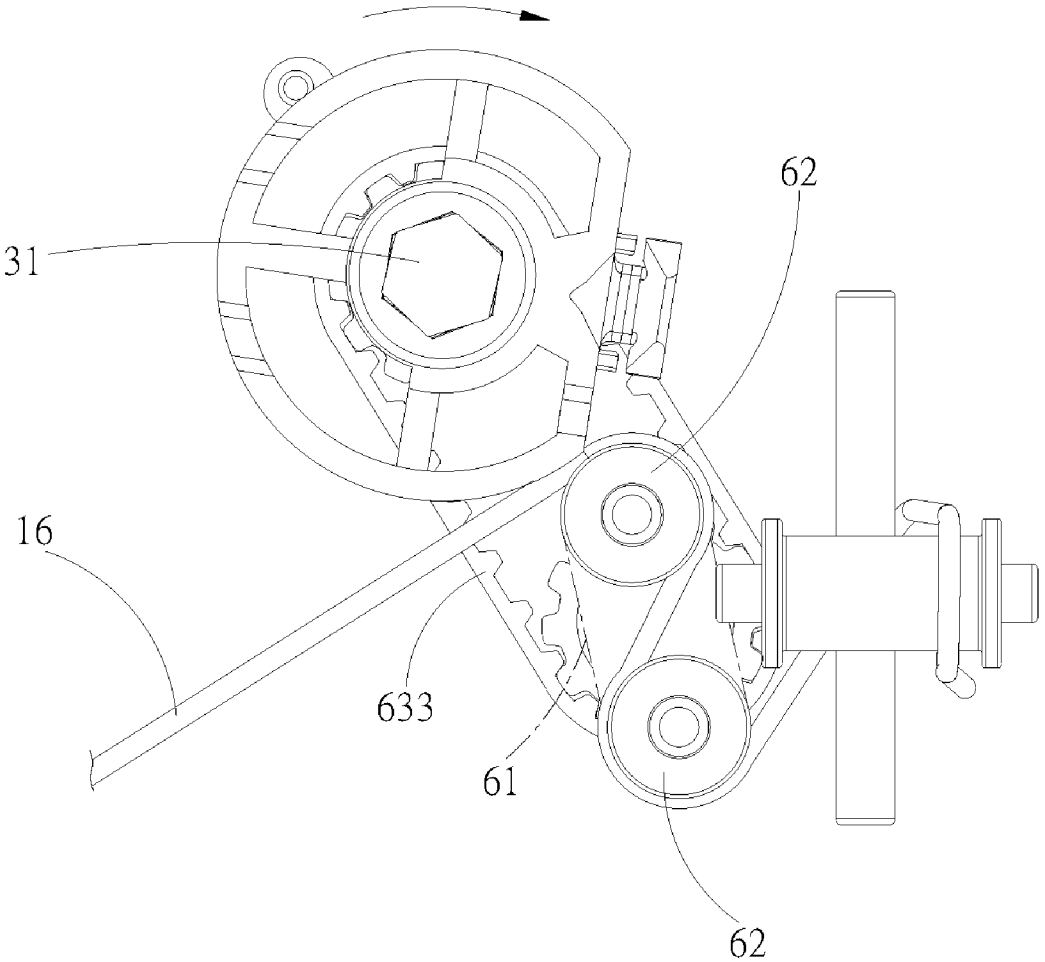
FIG. 21 is a left side view of FIG. 20.

As shown in FIG. 20 and FIG. 21, when the modulation shaft 31 is driven to rotate the driving gear 631, the driven gear 632 is also driven through the transmission belt 633. Whereby, the driven gear 632 drives the rotary seats 61 to pivot around the pivot 611. At the same time, the interference members 62 gradually presses and twists the rear cord 16, causing the segment of the rear cord 16 exposed out of the first rail 11 to be drawn into the first rail 11. Meanwhile, the length of the segment of the rear cord 16 between the bottom edge of the first rail 11 and the top edge of the second rail 12 is the second length L2, wherein the second length L2 is less than the first length L1. Therefore, the adjustment unit 6 of the current embodiment could be also driven by the modulation mechanism 3. Whereby, when the slats 13 are modulated to be turned from the first position P1 to the second position P2, the adjustment unit 6 synchronically drives the rear cord 16 to move upward. As a result, the length of the segment of the rear cord 16 exposed out of the first rail 11 would be changed, so that the second rail 12 could be turned in accordance to the tilt angle of the slats 13 turned by the ladder tape 14, and the warps 141 of the ladder tape 14 would approach each other, which could improve the problem of light leakage.

In the above embodiments, the adjustment units could change the length of the segment of the rear cord exposed out of the first rail. However, such illustrations are merely examples, and are not limitations of the arrangements of an adjustment unit. In other embodiments, the adjustment unit can be also provided in a way that it drives the front cord to change the length of the segment of the front cord exposed out of the first rail. In this way, the second rail could be also simultaneously turned along with the slats since the front cord and the rear cord can have different lengths. In addition, the present invention is not limited to the manner of reducing the length of the front cord or the rear cord with an adjustment unit. Conversely, the length of the exposed segment of the rear cord can be also changed by increasing the length of said segment exposed out of the first rail. In other words, as long as the length of at least one of the front cord and the rear cord can be changed through an adjustment unit to make them have different lengths, and the second rail can be simultaneously turned along with the slats, related designs should be considered to fall within the concept of the present invention.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A window blind, comprising:

a first rail;

a second rail;

a lifting module connected to the first rail;

a first cord and a second cord, each of which passes through and extends out of the first rail, and has an end connected to the lifting module and another end connected to the second rail;

a plurality of slats located between the first cord and the second cord;

a ladder tape which comprises at least two warps, wherein the slats are suspended between the first rail and the second rail through the ladder tape, and the slats are located between the warps;

a modulation mechanism, which is adapted to drive the warps of the ladder tape to make a relative movement in a vertical direction, whereby to drive the slats to turn between a first position and a second position; and an adjustment unit located between the lifting module and the slats, wherein the first cord passes through the adjustment unit;

wherein the first cord and the second cord are adapted to be driven to move the second rail toward or away from the first rail, whereby to raise or lower the slats; when the slats are fully lowered and are in the first position, a length of a segment of each of the first cord and the second cord between a bottom edge of the first rail and a top edge of the second rail is defined as a first length; when the slats are driven by the modulation mechanism to turn from the first position to the second position, the adjustment unit is driven to move the first cord, wherein, at this time, a length of a segment of the first cord between the bottom edge of the first rail and the top edge of the second rail is defined as a second length; the second length is different from the first length.

2. The window blind of claim 1, wherein the adjustment unit is adapted to be driven by the modulation mechanism to move the first cord.

3. The window blind of claim 2, wherein the modulation mechanism comprises at least a modulation shaft, which is rotatably provided in the first rail; the warps of the ladder tape are adapted to be driven by a rotation of the modulation shaft to make the relative movement; the adjustment unit comprises an interference member, wherein the first cord extends from the lifting module, passes by the interference member, and extends out of the first rail to be connected to the second rail; when the slats are driven by the modulation mechanism to be in the second position, the interference member operates along with the rotation of the modulation shaft, making the interference member twist the first cord.

4. The window blind of claim 3, wherein the adjustment unit further comprises a rotary seat, which is linked to and operates along with the modulation shaft; the interference member is provided at the rotary seat to be synchronically moved along with the rotary seat.

5. The window blind of claim 4, wherein the interference member comprises a cord ring pivotally provided at the rotary seat, and the rotary seat fixedly fits around the modulation shaft to be synchronically rotated along with the modulation shaft in a same direction; the first cord extends from the lifting module, passes through the cord ring, and extends out of the first rail.

6. The window blind of claim 5, wherein the cord ring has a limiting segment; when the rotary seat is driven by the modulation shaft to move the cord ring, the limiting segment of the cord ring presses the first cord, whereby the first cord is simultaneously moved along with the cord ring; when the slats are in the second position, the limiting segment twists the first cord.

7. The window blind of claim 4, wherein an end of each of the warps of the ladder tape is respectively connected to the rotary seat, which is adapted to be driven by the modulation shaft to move the warps, whereby to make the relative movement of the warps.

8. The window blind of claim 4, wherein the rotary seat is rotatably provided in the first rail; the adjustment unit further comprises a transmission gear fixedly provided on the modulation shaft, and the transmission gear is linked to and operates along with the rotary seat; the interference member is provided at the rotary seat, and the first cord passes by the interference member; the modulation shaft is adapted to be driven to rotate the transmission gear, whereby to drive the rotary seat to rotate, urging the interference member to twist the first cord.

9. The window blind of claim 8, wherein the transmission gear comprises a first bevel teethed portion, and the rotary seat comprises a rotary disc and a second bevel teethed portion; the rotary disc is rotatably provided in the first rail; the second bevel teethed portion is provided on the rotary disc, and meshes with the first bevel teethed portion; the interference member is provided at the rotary disc.

10. The window blind of claim 9, wherein the rotary disc of the rotary seat has an upper disc body and a lower disc body, which are separated by a distance; the interference member comprises at least a block, which is fixedly provided between the upper disc body and the lower disc body, and is not at a rotating center of the rotary disc; the first cord passes through a space between the upper disc body and the lower disc body, and also passes by the block.

11. The window blind of claim 1, wherein the lifting module comprises a power mechanism, which is provided in the first rail; the end of each of the first cord and the second cord is connected to the power mechanism, while the another end thereof is connected to the second rail.

12. The window blind of claim 4, wherein the rotary seat is rotatably provided in the first rail; the adjustment unit further comprises a transmission assembly, which is linked to and operates along with the modulation shaft; the transmission assembly is also linked to and operates along with the rotary seat; the interference member is provided at the rotary seat, and the first cord passes by the interference member; the modulation shaft is adapted to be driven to rotate the transmission assembly, whereby to drive the rotary seat to pivot, urging the interference member to twist the first cord.

13. The window blind of claim 12, wherein the transmission assembly comprises a driving gear, a transmission belt, and a driven gear; the driving gear is fixedly provided at the modulation shaft; the driven gear is fixedly provided at the rotary seat; the transmission belt is respectively connected to and operates along with the driving gear and the driven gear; the modulation shaft is adapted to be driven to rotate the driving gear, whereby the driven gear is driven to rotate through the transmission belt, which drives the rotary seat to pivot.

14. The window blind of claim 13, wherein the rotary seat comprises a swing arm, which has a pivot; the pivot and the driven gear are fixedly provided; the driven gear is adapted to operate along with the transmission belt, whereby to drive the swing arm to pivot around the pivot.

15. The window blind of claim 14, wherein the interference member comprises a pressing wheel, which is provided at the swing arm; the first cord passes through the pressing wheel; the swing arm is adapted to be driven by the driven gear to pivot around the pivot, whereby to drive the pressing wheel to press and twist the first cord.

* * * * *